United States Patent [19]

Sullivan et al.

[11] Patent Number: 4,932,164

[45] Date of Patent: Jun. 12, 1990

[54] COUNTERBALANCE SAFETY GUARD FOR A DUAL ACTION SANDER

[76] Inventors: Glenn F. Sullivan, R.D. Box 212, Addison, N.Y. 14801; Douglas J. Kellogg, P.O. Box 154, Campbell, N.Y. 14821

[21] Appl. No.: 219,137

[22] Filed: Jul. 13, 1988

[51] Int. Cl.[5] ..... B24B 23/00

[52] U.S. Cl. ..... 51/170 MT; 51/268

[58] Field of Search ..... 51/170 MT, 268, 271

[56] References Cited

U.S. PATENT DOCUMENTS

| | | | |
|---|---|---|---|
| 556,681 | 3/1896 | Landers | 51/268 |
| 2,270,309 | 1/1942 | Kehle | 51/170 MT |
| 2,422,733 | 6/1947 | Jimerson | 121/34 |
| 2,441,506 | 5/1948 | Osman | 51/170 MT |
| 2,786,313 | 3/1957 | Shaff | 51/170 MT |
| 2,948,091 | 8/1960 | MacFarland | 51/268 |
| 3,496,680 | 2/1970 | Hutchins | 51/170 |
| 3,543,449 | 1/1965 | Scott et al. | 51/170 MT |
| 3,579,915 | 5/1971 | Satterthwaite-Wilcox | 51/120 |
| 4,059,930 | 11/1977 | Alessio | 51/268 |
| 4,145,848 | 3/1979 | Hutchins | 51/170 T |
| 4,322,921 | 4/1982 | Maier | 51/170 MT |
| 4,403,457 | 9/1983 | Zerbe | 51/170 T |
| 4,467,565 | 8/1984 | Wallace et al. | 51/170 MT |
| 4,488,383 | 12/1984 | Zerbe | 51/170 T |
| 4,592,170 | 6/1986 | Hutchins et al. | 51/170 MT |
| 4,610,111 | 9/1986 | Cox | 51/168 |

FOREIGN PATENT DOCUMENTS

| | | | |
|---|---|---|---|
| 690037 | 4/1953 | United Kingdom | 51/268 |

*Primary Examiner*—Judy Hartman

*Attorney, Agent, or Firm*—Ralph R. Barnard

[57] ABSTRACT

The present invention is a counterbalance safety guard for a dual action sander designed to protect the user from the rotating and moving parts. This invention also includes a teaching which would permit adjustment of the sander from the circular sanding mode to the oscillating sanding mode without removing the guard.

7 Claims, 3 Drawing Sheets

COUNTERBALANCE SAFETY GUARD FOR A DUAL ACTION SANDER

BACKGROUND OF THE INVENTION

1. Field of the Invention

The present invention relates to an improvement in protective guards for abrading tools, and more particularly to a counterbalance safety guard for a dual action sander.

2. Description of the Prior Art

It is known to equip both stationary and portable power tools having a rotating head with a guard for protecting the user of the tool against injury should the work wheel or drill driven by the rotating head break during use of the tool.

However, the prior art does not teach a guard designed to attach to a dual action sander which oscillates (reciprocates laterally) as well as rotates. The oscillation and required eccentric counterbalance creates a hazard unique to dual action sanders. The counterbalance remains exposed on these tools and as a result of its rapid rotation it becomes extremely hazardous to the user's hands when the sander is turned on.

Presumably the reason that a guard is not sold with a dual action sander is that it would hinder the adjustment of the sander from the regular circular sanding mode to the oscillating sanding mode and vice versa. The shift from one mode to another is made by adjusting a locking mechanism which is in close proximity to the counterbalance. Therefore, if the counterbalance were to be covered so would the locking mechanism. Consequently, any guard protecting the user from the rotating counterbalance would have to be removable to permit adjustment of the sander from one mode to another. However, it is too cumbersome to remove a guard every time the user wants to switch from one mode to another. Thus, counterbalance guards for dual action sanders are not known.

SUMMARY OF THE INVENTION

The present invention is a counterbalance safety guard for a dual action sander designed to protect the user from the rotating and moving parts, including the rotating counterbalance. This invention also includes a teaching which would permit adjustment of the sander from the circular sanding mode to the oscillating sanding mode without removing the guard.

It is an object of the present invention to provide a guard for a dual action sander which protects the user from the rotating and moving parts, particularly the eccentric counterbalance and locking mechanism It is another object of the present invention to provide a guard for a dual action sander which may be easily removed or attached, but which may be permanently attached without interfering with the functioning of the sander.

It is still another object of the present invention to provide a guard for a dual action sander which is designed so that selective access to the covered parts of the sander is possible and adjustment may be made thereto.

The above objectives and advantages of our invention will become more apparent from a consideration of the detailed description to follow taken in conjunction with the drawings annexed hereto.

DESCRIPTION OF THE PREFERRED EMBODIMENT

Figure 1:
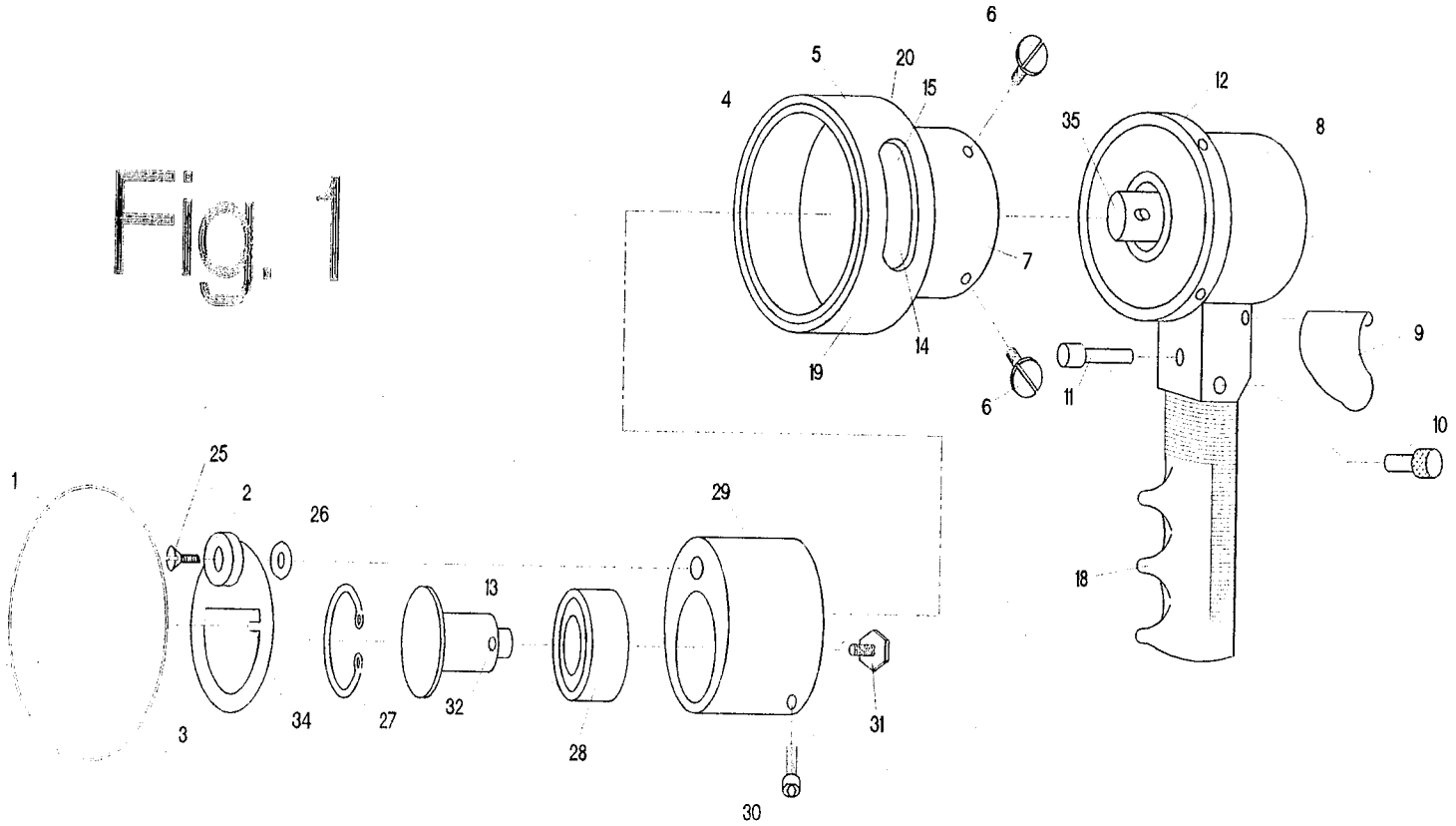
FIG. 1 is an exploded perspective representation of the various parts forming the inventive cover and the dual action sander.
Figure 2:
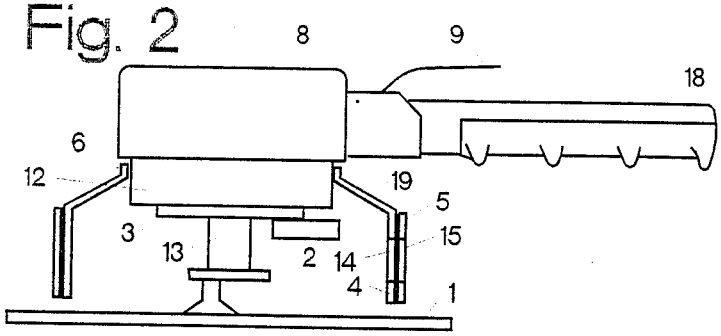
FIG. 2 is a cross-sectional side view of a conventional dual action sander with the inventive guard attached thereto.

FIGS. 1 & 2 best illustrate how the parts of the dual action sander and the inventive safety guard fit together. The body of the dual action sander is made up of handle 18 and motor housing 8 and motor shaft 35. Attached thereto is valve lever 9, air regulator 10, and valve stem 11. As shown in detail in FIG. 1, lock screw 31 protrudes through the random balance body 29, through ball bearing 28 and into random shaft 13. In the dual action sander, motor shaft 35 (a first rotating shaft output) is driven by the motor 8 (in this case an air motor) and the random output shaft 13 (a second rotating shaft output) is rotated by the eccentric counterbalance and locking mechanism comprising lock screw 31 and random balance body 29 including attaching screw 30. Retaining ring 27 fits between random shaft 13 and the lock ring 3. Screw balance nut 25 protrudes through counterbalance nut 2, wave washer 26, and random balance body 29. Locking protrusion 34 on lock ring 3 fits into the locking hole 32 on random shaft 13 to lock the sander in the oscillating sanding mode.

While the dual action sander is shown as air driven, it could be driven by any other conventional motor means, including an electric motor.

The inventive guard, designated generally at 19, is secured to rim 12 of the motor housing 8 by means of attachment screws 6. It covers lock ring 3 and counterbalance nut 2 attached thereto. Sanding pad 1, which rotates on random shaft 13, remains unhindered by the guard 19.

The problem which the present invention seeks to correct is the hazard created by the rotating and moving parts of a dual action sander. However, a guard which covers the counterbalance will necessarily cover the locking mechanism which switches the sander from a circular sanding mode to an oscillating sanding mode and vice versa. Therefore, it is necessary that a guard for a dual action sander be removable and/or designed so that access to the locking mechanism is possible. The inventive guard described in detail hereinafter is designed to be easily removed or attached, but may be permanently attached without interfering with the functioning of the sander.

The guard 19 consists of an inner shroud 4 having one or more access ports 14 and an outer shroud 5 having one or more corresponding access ports 15 and means to attach the inner and outer shrouds together. The neck 7 of the inner shroud 4 is smaller in diameter than the body 20 of the guard and is manufactured to fit and attach to the rim 12 of the motor housing. While the neck 7 of the guard must be narrow enough to attach to the motor housing, the body 20 of the guard must be large enough diameter to clear the oscillating counterbalance nut 2 when the dual action sander is operating.

Figure 3:
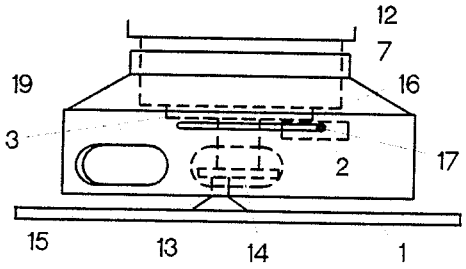
FIG. 3 is a side view of the preferred embodiment of the inventive guard as properly attached to the motor housing and situated in such a way that access to the parts of the dual action sander contained therein is not possible.
Figure 4:
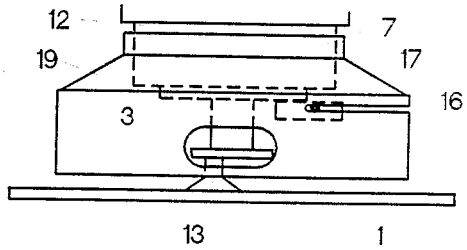
FIG. 4 is the same side view of the preferred embodiment of the inventive guard as in FIG. 3, except that it is situated so that access to the parts of the dual action sander contained therein is possible.

The means for attaching the inner shroud 4 to the outer shroud 5 must permit the outer shroud 5 to rotate around the inner shroud 4. As illustrated in FIGS. 3 & 4, a bolt 17 is secured through both the inner shroud 4 and outer shroud 5 to slide along slot 16. A spring washer may be added between the bolt 17 and the outer shroud 5 to help keep the bolt snug.

The inventive guard 19 may be adapted to many dual action sander models including those of Ludell Model No. Das-3, Black and Decker, Astropower, Sears & Roebuck, and Ingersoll-Rand. The guard 19 is attached to the dual action sander by first removing the sanding pad 1 and then fitting the neck 7 of the inner shroud 4 over the lock ring 3 and counterbalance nut 2. The guard 19 is attached to the rim 12 of the motor housing 8 by lining up the holes in the neck 7 with corresponding holes drilled in the rim 12 and screwing the attachment screws 6 therein. The sanding pad 1 is then screwed into the random shaft 13.

Referring now to FIG. 3, the outer shroud 5 is turned clockwise as far as bolt 17 will let it move. In this position, inner access port 14 and outer access port 15 are not aligned. Therefore, access to the rotating and oscillating parts is not possible and the guard 19 is fully effective as it covers the counterbalance nut 2. The dual action sander may now be safely used.

Access ports 14 & 15 in guard 19 are only necessary for dual action sanders having two possible modes, one of which may be selected by adjusting a mechanism such as lock ring 3. Access is necessary to adjust the dual action sander from the circular sanding mode to the oscillating sander mode and vice versa. The guard 19 is required even when using the regular circular sanding mode, because the counterbalance nut 2 and lock ring 3 remains exposed in both modes.

Referring now to FIG. 4, the outer shroud 5 is turned counterclockwise as far as bolt 17 can slide along slot 16. In this position, inner access port 14 and outer access port 15 are aligned. Therefore, access for the purpose of adjusting the locking mechanism 3 is possible.

An additional safety feature could be added to the present invention which would prevent the sander from operating when the access ports were aligned in the open position. However, this additional safety feature would require that the dual action sander be designed with a trigger valve 11 which extended farther out through the handle 18. A cam lobe could be installed on the outer shroud body so that when the access ports 14 & 15 are aligned in the open position the cam lobe would abut against the trigger valve 11 to prevent the sander from being operated while the counterbalance was exposed.

Figure 5:
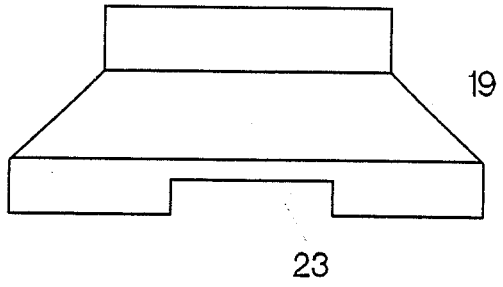
FIGS. 5, 6, & 7 are alternative embodiments made in accordance with the teachings of the present invention.

Referring now to FIG. 5, an alternative embodiment of the present invention is shown. This embodiment of the guard 19 is the easiest of the disclosed embodiments to manufacture since it is only made up of one continuous piece of material. A small area is cut out 23 to allow access to adjust the sander from one mode to another.

Figure 6:
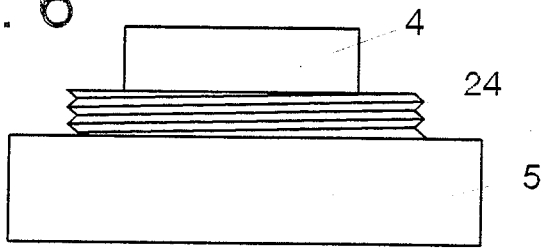

Another alternative embodiment of the guard 19 is shown is FIG. 6. The inner shroud 4 has screw threads 24 on the outside and the outer shroud 5 has screw threads on the inside. Access to adjust the sander is made by rotating the outer shroud counterclockwise which causes it to elevate to a position which exposes the locking mechanism.

Figure 7:
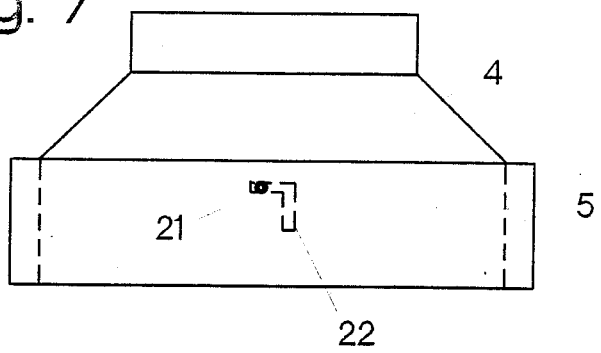

Still another alternative embodiment of the guard 19 is illustrated in FIG. 7. It uses the same lift and lower concept as used in the embodiment of FIG. 6. The inner shroud 4 has a two or more screws 21 which slide along two or more cooperating L-shaped grooves 22 cut in the inside of the outer shroud 5. Access for the purpose of adjusting the sander from the circular sanding mode to the oscillating sanding mode is made by rotating the outer shroud 5 counterclockwise and then pushing it up to a position which exposes the locking mechanism.

The embodiments described herein are made of polyvinyl chloride (PVC) pipe, which is the least expensive material, but they could also be made of other materials such as aluminum, sheet metal, or plastic.

Although I have herein shown and described a preferred embodiment and a few alternative embodiments of my invention, it will be apparent to those skilled in the art to which the invention appertains that various other changes and modifications may be made to the subject invention without departing from the spirit and scope thereof, and therefore it is to be understood that all modifications, variations, and equivalents within the spirit and scope of the subject invention are herein meant to be encompassed in the appended claims.

We claim:

1. In combination a dual action sander, and a guard comprising:

motor means having a first rotating shaft output;

a second rotating shaft output;

means connected to said first output for converting said rotary motion into lateral reciprocating motion involving an eccentric counterbalance and locking mechanism which rotates off center from the first rotating shaft so that said second rotating shaft output may also move in a reciprocating lateral motion, said counterbalance rotating in both modes about an axis which is coincident with the second shaft output of the motor;

a guard means coaxial to the said counterbalance and locking mechanism placed around said mechanism including said counterbalance and locking mechanism to protect users from being injured by said rotating counterbalance and locking mechanism;

said coaxial guard having an access port therein for the purpose of reaching the said locking mechanism to change the said dual action sander from one dual action mode to the other;

said coaxial guard comprising an inner and outer coaxial shroud movable with respect to one another for giving access to the said locking mechanism when changing the dual action sander from one dual action mode to the other.

2. In combination a dual action sander, and a guard comprising:

motor means having a first rotating shaft output;

a second rotating shaft output;

means connected to said first output for converting said rotary motion into lateral reciprocating motion involving an eccentric counterbalance and locking mechanism which rotates off center from the first rotating shaft so that said second rotating shaft output may also move in a reciprocating lateral motion, said counterbalance rotating in both modes about an axis which is coincident with the second shaft output of the motor;

a guard means coaxial to the said counterbalance and locking mechanism placed around said mechanism including said counterbalance and locking mechanism to protect users from being injured by said rotating counterbalance and locking mechanism;

said coaxial guard having an access port therein for the purpose of reaching the said locking mechanism to change the said dual action sander from one dual action mode to the other;

said guard further comprising:

inner cylindrical shroud means having a narrowed neck portion and a wider body portion;

said neck portion being for attachment to a dual action sander;

means for attaching said inner shroud to the dual action sander;

outer cylindrical shroud means mounted coaxially to the inner shroud attached to slide along the exterior of said inner shroud means;

one or more inner access ports cut out of said inner shroud means;

one or more corresponding access ports cut out of said outer shroud means; and said access ports lining up to permit adjustment to the locking mechanism of the dual action sander.

3. In combination a dual action sander, and a guard comprising:

motor means having a first rotating shaft output;

a second rotating shaft output;

means connected to said first output for converting said rotary motion into lateral reciprocating motion involving an eccentric counterbalance and locking mechanism which rotates off center from the first rotating shaft so that said second rotating shaft output may also move in a reciprocating lateral motion, said counterbalance rotating in both modes about an axis which is coincident with the second shaft output of the motor;

a guard means coaxial to the said counterbalance and locking mechanism placed around said mechanism including said counterbalance and locking mechanism to protect users from being injured by said rotating counterbalance and locking mechanism;

said coaxial guard having an access port therein for the purpose of reaching the said locking mechanism to change the said dual action sander from one dual action mode to the other;

the said guard means comprising:

inner cylindrical shroud means having a neck portion and a body portion;

said neck portion being for attachment to the rim of the motor housing of a dual action sander and a body portion having screw threads thereupon;

outer cylindrical shroud means mounted coaxially to the inner shroud means; and said outer shroud means having screw threads therein for cooperation with the screw threads in said inner shroud means for the purpose of rising and lowering said outer shroud means with respect to said inner shroud means.

4. In combination a dual action sander, and a guard comprising:

motor means having a first rotating shaft output;

a second rotating shaft output;

means connected to said first output for converting said rotary motion into lateral reciprocating motion involving an eccentric counterbalance and locking mechanism which rotates off center from the first rotating shaft so that said second rotating shaft output may also move in a reciprocating lateral motion, said counterbalance rotating in both modes about an axis which is coincident with the second shaft output of the motor;

a guard means coaxial to the said counterbalance and locking mechanism placed around said mechanism including said counterbalance and locking mechanism to protect users from being injured by said rotating counterbalance and locking mechanism;

said coaxial guard having an access port therein for the purpose of reaching the said locking mechanism to change the said dual action sander from one dual action mode to the other;

the said guard means comprising:

inner cylindrical shroud means having a neck portion and body portion;

said neck portion being for attachment to the rim of the motor housing of a dual action sander;

outer cylindrical shroud means mounted coaxially to the inner shroud means;

two or more L-shaped grooves inside said outer shroud means; and two or more protruding means in said body portion of said inner shroud means to slide along said L-shaped grooves in said out shroud means for the purpose of raising and lowering said outer shroud means with respect to said inner shroud means.

5. In combination a dual action sander, and a removable counterbalance safety guard comprising:

motor means having a first rotating shaft output;

a second rotating shaft output;

means connected to said first output for converting said rotary motion into lateral reciprocating motion involving an eccentric counterbalance and locking mechanism which rotates off center from the first rotating shaft so that said second rotating shaft output may also move in a reciprocating lateral motion, said counterbalance rotating in both modes about an axis which is coincident with the second shaft output of the motor;

a guard means coaxial to the said counterbalance and locking mechanism placed around said mechanism including said counterbalance and locking mechanism to protect users from being injured by said rotating counterbalance and locking mechanism;

said coaxial guard having an access port therein for the prupose of reaching the said locking mechanism to change the said dual action sander from one dual action mode to the other;

said coaxial guard comprising:

inner cylindrical shroud means having a narrowed neck portion and a wider body portion;

said neck portion being for attachment to a dual action sander;

means for attaching said inner shroud to the dual action sander;

outer cylindrical shroud means mounted coaxially to the inner shroud means attached to slide along the exterior of said inner shroud means;

one or more inner access ports cut out of said inner shroud means;

one or more corresponding access ports cut out of said outer shroud means; and said access ports lining up to permit adjustment to the locking mechanism of the dual action sander.

6. In combination, a dual action sander, and a removable counterbalance safety guard comprising:

motor means having a first rotating shaft output;

a second rotating shaft output;

means connected to said first output for converting said rotary motion into lateral reciprocating motion involving an eccentric counterbalance and locking mechanism which rotates off center from the first rotating shaft so that said second rotating shaft output may also move in a reciprocating lateral motion, said counterbalance rotating in both modes about an axis which is coincident with the second shaft output of the motor;

a guard means coaxial to the said counterbalance and locking mechanism placed around said mechanism including said counterbalance and locking mechanism to protect users from being injured by said rotary counterbalance and locking mechanism;

said coaxial guard having an access port therein for the prupose of reaching the said locking mechanism to change the said dual action sander from one dual action mode to the other;

said coaxial guard comprising:

inner cylindrical shroud means having a neck portion and a body portion;

said neck portion being for attachment to the rim of the motor housing of a dual action sander and a body portion having screw threads thereupon;

outer cylindrical shroud means mounted coaxially to the inner shrouds means; and said outer shroud means having screw threads therein for cooperation with the screw threads in said inner shrouds means for the purpose of raising and lowering said outer shrouds means with respect to said inner shroud means.

7. In combination, a dual action sander, and a removable counterbalance safety guard comprising:

motor means having a first rotating shaft output;

a second rotating shaft output;

means connected to said first output for converting said rotary motion into lateral reciprocating motion involving an eccentric counterbalance and locking mechanism which rotates off center from the first rotating shaft so that said second rotating shaft output may also move in a reciprocating lateral motion, said counterbalance rotating in both modes about an axis which is coincident with the second shaft output of the motor;

a guard means coaxial to the said counterbalance and locking mechanism placed around said mechanism including said counterbalance and locking mechanism to protect users from being injured by said rotating counterbalance and locking mechanism; said coaxial guard having an access port therein for the prupose of reaching the said locking mechanism to change the said dual action sander from one dual action mode to the other; said coaxial guard comprising:

inner cylindrical shroud means having a neck portion and a body portion;

said neck portion being for attachment to the rim of the motor housing of a dual action sander;

outer cylindrical shroud means mounted coaxially to the inner shroud means;

two or more L-shaped grooves inside said outer shroud means; and two or more protruding means in said body portion of said inner shroud means to slide along said L-shaped grooves in said outer shroud means for the purpose of raising and lowering said outer shroud means with respect to said inner shroud means.

* * * * *